US005867874A

United States Patent [19]

Simpson

[11] Patent Number: 5,867,874

[45] Date of Patent: Feb. 9, 1999

[54] IMPLEMENT HOLDER ATTACHED TO A HAT OR CAP

[76] Inventor: David Simpson, 3381 "E" Rd., Loxahatchee, Fla. 33470

[21] Appl. No.: 888,622

[22] Filed: Jul. 7, 1997

Related U.S. Application Data

[60] Provisional application No. 60/042,135, Apr. 8, 1997.

[51] Int. Cl.[6] ..... B43K 25/00; A44B 21/00

[52] U.S. Cl. ..... 24/336; 24/3.12; 24/3.3; 24/10 R; 24/16 R; 248/316.7

[58] Field of Search ..... 24/10 R, 11 R, 24/11 HC, 11 CC, 11 PP, 30.5 R, 30.5 D, 336, 339, 3.2–3.4, 3.12, 3.11, 3.7; 248/316.7, 902

[56] References Cited

U.S. PATENT DOCUMENTS

| | | | |
|---|---|---|---|
| 0,637,889 | 11/1899 | Parker . | |
| 0,803,464 | 10/1905 | Beck . | |
| 1,481,984 | 1/1924 | Carnett . | |
| 2,345,051 | 3/1944 | Jensen . | |
| 2,614,305 | 10/1952 | Yeardley | 24/3.12 X |
| 2,802,250 | 8/1957 | Klotz . | |
| 2,832,114 | 4/1958 | Mead | 24/10 R |
| 3,231,076 | 1/1966 | Frieman | 24/336 X |
| 3,626,553 | 12/1971 | Darney et al. | 24/336 X |
| 3,769,663 | 11/1973 | Perf | 24/3.3 |
| 3,802,032 | 4/1974 | Weed | 24/336 X |
| 3,983,602 | 10/1976 | Barry . | |
| 4,276,657 | 7/1981 | Montesi . | |
| 4,852,221 | 8/1989 | Antonucci | 24/3.12 X |
| 5,066,154 | 11/1991 | Renaud . | |
| 5,082,225 | 1/1992 | Nespoli | 248/317.6 X |
| 5,184,375 | 2/1993 | Hoyt . | |
| 5,463,189 | 10/1995 | Deneke et al. | 24/336 X |
| 5,495,644 | 3/1996 | Mesher et al. | 24/16 R |
| 5,573,167 | 11/1996 | Bebb et al. | 24/336 X |
| 5,573,217 | 11/1996 | Garvey et al. | 248/316.7 |
| 5,640,743 | 6/1997 | Greene et al. | 24/10 R |

*Primary Examiner*—Randolph A. Reese
*Assistant Examiner*—Robert J. Sandy
*Attorney, Agent, or Firm*—Tom Hamill, Jr.

[57] ABSTRACT

An implement holder to be attached to a cap or hat is provided. The holder is designed to be affixed to the side portion of the cap proximal the edge. The holder is an integral unit including a first leg, second leg and third leg. The first leg and the second leg are interconnected to form a first jaw or clamp, the first leg to be received between the cap and the head and the second leg to remain outside and flush to the cap. The first leg is resilient and includes means to maintain attachment to the cap. The side of the cap is placed intermediate the first leg and the second leg. The third leg and second leg are interconnected and form a second jaw or clamp which has the general shape of an U-shaped channel. The U-shaped channel is generally parallel to the cap when the holder is affixed thereto. The channel includes a plurality of longitudinal ridges located on the interior channel walls of the third leg and second leg. The second jaw may receive a pencil, pen or other elongated implement. The small ridges help retain the pencil, pen or other elongated implement in positive relation within the second jaw. The third leg is also resilient and imparts a retaining force on the instrument being retained in the channel. The outer wall of the third leg is smooth and is designed to receive identifying or advertising indicia. The holder may also be affixed to the temple of eyewear, including glasses, sunglasses, or protective eyegear.

11 Claims, 2 Drawing Sheets

IMPLEMENT HOLDER ATTACHED TO A HAT OR CAP

This Application claims the benefit of U.S. Provisional Application No. 60/042,135, filed on Apr. 8, 1997.

BACKGROUND OF THE INVENTION

1. Field of the Invention

The present invention relates generally to retaining mechanisms, and more particularly, to a retaining mechanism especially adapted to be affixed to a cap and retain a pencil therein, the pencil thus being made accessible for immediate use. The instant device may also be employed with a pair of eyeglasses.

2. Description of the Prior Art

Devices which retain pencils or other elongated devices have been disclosed in the art. U.S. Pat. No. 803,464 issued to Beck discloses a pencil holder combined with a book mark. The holding mechanism is designed to be affixed to a book to mark the page. A pair of oppositely oriented pencil holders are stationed on one side of the clip element. Pencils may be slidingly received within the holders.

U.S. Pat. No. 1,481,984 issued to Carnett also discloses a pencil clip or holder designed to be utilized with a book. A clip is designed to be affixed to one of the covers of the book with a generally c-shaped pencil receiving element attached thereto. A book marker securing device in the form of a flexible elongated element is also provided.

U.S. Pat. No. 3,983,602 issued to Barry discloses an implement holder for a safety helmet. A one piece holder is formed of molded plastic having a first clamp for releasably engaging an edge portion of a safety helmet to detachably mount the holder thereon, and a second clamp projecting outwardly from one jaw of the first clamp for detachably receiving and holding a long slender object such as a pencil or a pen.

U.S. Pat. No. 5,066,154 issued to Renaud which discloses a pencil support for a security hat. The support includes a generally flat member which is formed of a slight curvature enabling it to rest against the surface of the security hat. A hook is formed from the member enabling to introduce and hold a pencil or an elongated object. A clip element depends from the support which secures the device to the bottom edge of the security hat. The clip element is of a specific structural configuration which would allow mating with a security or construction hat specifically.

Thus, while the foregoing body of prior art indicates it to be well known to use generally complex structural devices to attach elongated devices such as pencils to certain hat structure and/or books, the provision of a simply designed, unitary pencil clip, which may be affixed to a common 'baseball' style cap has not been contemplated. The prior art does not show any devices which have the structural characteristics of the instant invention. The foregoing disadvantages are overcome by the unique and simple structural configuration of the present invention as will be made apparent from the following description thereof. Other advantages of the present invention over the prior art also will be rendered evident.

SUMMARY OF THE INVENTION

To achieve the foregoing and other advantages, the present invention, briefly described, provides an implement holder to be attached to a cap or hat. The holder is designed to be affixed to the side portion of the cap proximal the edge.

The holder is an integral unit including a first leg, second leg and third leg. The first leg and the second leg are interconnected to form a first jaw, the first leg to be received between the cap and the head and the second leg to remain outside and flush to the cap. The first leg is resilient and includes means to maintain attachment to the cap. The side of the cap is placed intermediate the first leg and the second leg. The third leg and second leg are interconnected and form a second jaw in the shape of a generally U-shaped channel. When the holder is affixed the second jaw is generally parallel to the cap. The second jaw includes a plurality of longitudinal ridges located on the interior channel walls of the third leg and second leg. The second jaw may receive a pencil, pen or other elongated implement. The small ridges help retain the pencil, pen or other elongated implement in positive relation within the second jaw. The channel is dimensioned in order to be able to retain a rectangular carpenter's pencil as well as cylindrical writing instruments. The third leg is also resilient and imparts a retaining force on the instrument being retained in the second jaw. The outer wall of the third leg is smooth and is designed to receive identifying or advertising indicia. In the preferred embodiment, the implement holder may be manufactured of one-piece molded plastic or of metal.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide an implement holder attached to a hat or cap which may be quickly and easily affixed and removed from the headwear.

It is another object of the present invention to provide an implement holder attached to a hat or cap to detachably mount a long slender instrument such as, but not limited to a writing instrument.

It is another object of the present invention to provide an implement holder attached to a hat or cap which may retain a rectangularly configured elongated instrument such as a rectangular shaped pencil (carpenter's pencil), as well as a cylindrical pencil (pen).

It is another object of the present invention to provide an implement holder attached to a hat or cap with means to effectively grip the edge portion of a cap to prevent the holder from being inadvertently detached from the cap.

It is another object of the present invention to provide an implement holder 10 attached to a hat or cap with means to effectively grip the writing instrument or other elongated device to prevent the writing instrument from being inadvertently detached from the holder.

It is another object of the present invention to provide an implement holder attached to a hat or cap having a surface visible to others which may have indicia or other ornamental designs placed thereon.

It is another object of the present invention to provide an implement holder attached to a hat or cap which may be easily and efficiently manufactured and marketed.

It is a further objective of the present invention to provide an implement holder attached to a hat or cap which is of durable and reliable construction.

An even further object of the present invention is to provide an implement holder attached to a hat or cap which is susceptible of a low cost of manufacture with regard to both materials and labor, and which accordingly is then susceptible of low prices of sale to the consuming public, thereby making such an implement holder available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, an implement holder attached to a hat or cap embodying the principles and concepts of the present invention will be described.

Figure 1:
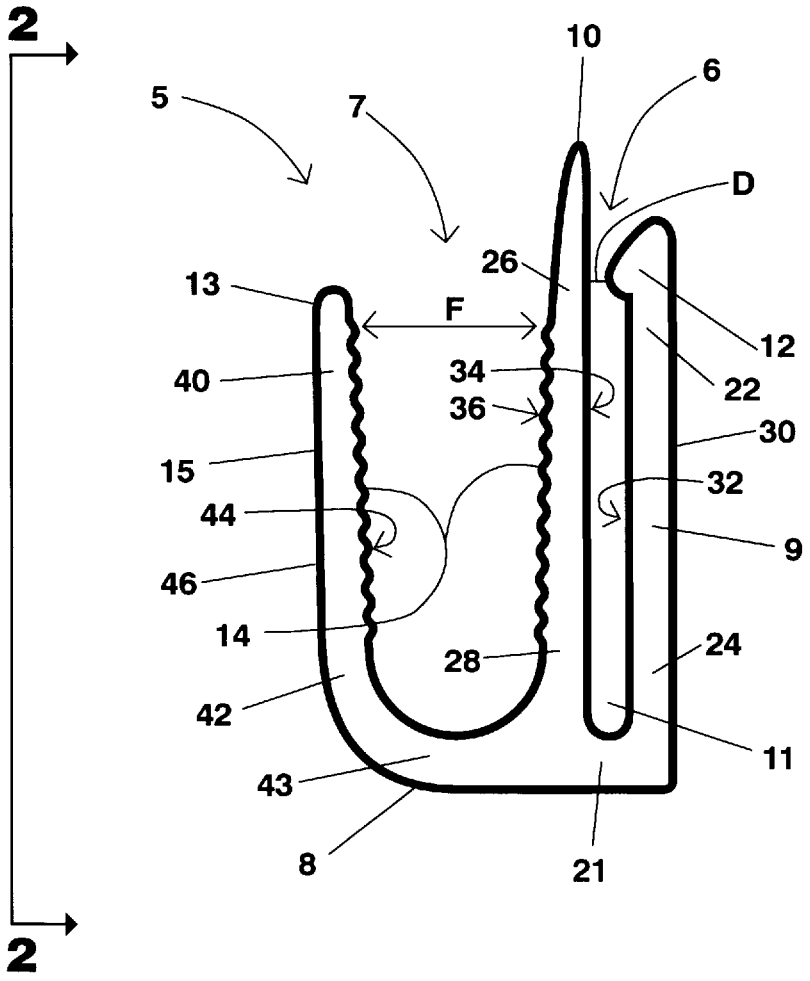
FIG. 1 is a side view of the implement holder to be attached to a hat, cap or eyewear.
Figure 2:
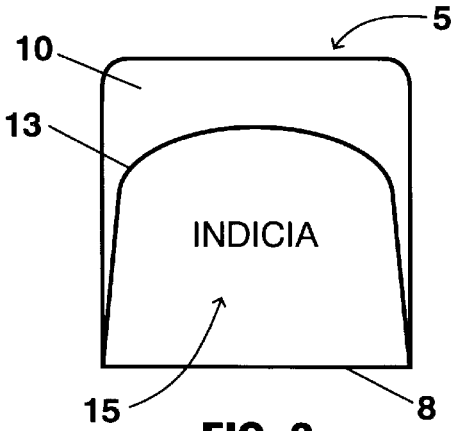
FIG. 2 is an elevational view of the implement holder to be attached to a hat, cap or eyewear taken along line 2—2 of FIG. 1.
Figure 3:
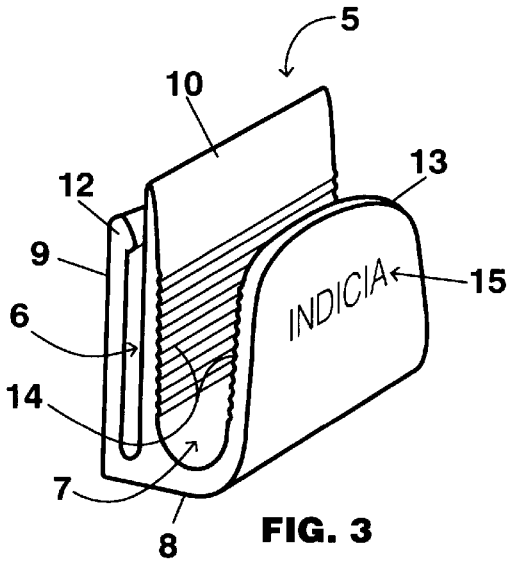
FIG. 3 is a perspective view of the implement holder to be attached to a hat, cap or eyewear.

Turning initially to FIGS. 1—3, there is shown the exemplary embodiment of the implement holder of the invention generally designated by reference numeral 5. The holder 5 may be of one-piece molded plastic construction or metal construction and includes a first hat clamp area 6 and a second implement clamp area 7, both of which generally span the length and the height of the of the device.

In its preferred form, holder 5 comprises includes a generally rectangular bottom portion 8, which forms a base for both the first hat clamp area 6 and the second implement clamp area 7.

The first clamp area 6 is formed of a first leg 9 and a second leg 10. The first leg 9 has an generally upper portion 22 and a generally lower portion 24. The second leg 10 has a generally upper portion 26 and a generally lower portion 28. The first leg 9 and the second leg 10 are interconnected about the first leg lower portion 24 and the second leg lower portion 28 by a first bottom portion 21. The first leg 9 includes a first side 30 and a second side 32. The second leg 10 includes a first side 34 and a second side 36. The area above the first bottom portion 21 and intermediate the first leg second side 32 and the second leg first side 34 forms and defines the first clamp area 6. The first clamp area 6 is designed to receive the edge portion of the cap 16 therein and attach the holder 5 firmly to the cap 16.

The first leg 9 is generally flat and rectangular and is parallel to the second leg 10. The first leg 9 may include a teardrop shaped protrusion 12 which spans the lateral length of about the upper portion 22 of the first leg's inner side 32. Some embodiments may not include a teardrop 12. This teardrop shaped protrusion or tooth 12 is included to permit better gripping of the holder 5 to the cap 16. First leg 9 is resilient and forms a cantilevered element with the upper portion 22 being the non-fixed end of the beam and the first bottom portion 21 being the fixed end of the beam. When the upper portion 22 of the first leg 9 is deflected to receive the edge of the brim of the cap 16, it will have a natural tendency to return to it's undeflected position. As such, when the width of the brim of the cap 16 exceeds the undeflected length D (the distance intermediate the teardrop protrusion 12 and the upper portion 26 of the second leg first side 34) there will be a natural gripping action mathematically related to the distance in excess of D. The mechanical shape of the teardrop protrusion 12 will prevent the holder 5 from sliding off of the cap 16.

The second leg 10 is generally rectangular and flat as well. The second leg upper portion 26 forms a knife or bayonet with a rounded top. Its general height in some embodiments may exceed that of the first leg 9 and the third leg 13. The second clamp area 7 is formed of the second leg 10 and the third leg 13. The second leg 10 has a generally upper portion 26 and a generally lower portion 28. The third leg 13 has a generally upper portion 40 and a generally lower portion 42. The second leg 10 and the third leg 13 are interconnected about the second leg lower portion 28 and the third leg lower portion 42 by a second bottom portion 43. As seen, bottom portion 8 includes the first bottom portion 21 and the second bottom portion 43. The second leg 10 includes a first side 34 and a second side 36. The third leg 13 includes a first side 44 and a second side 46. The area above the second bottom portion 43 and intermediate the second leg second side 36 and the third leg first side 44 forms and defines the second clamp area 7. The second clamp area 7 is designed to receive a pencil (rectangular or other geometry), pen, or other elongated device therein.

The third leg 13 is generally flat and rectangular and is generally parallel to the second leg 10. The second leg second side 36 and the third leg first side 44 include a plurality of ribs or serrations 14. The ribs 14 run laterally lengthwise along a majority of the surface area of the second leg second side 36 and the third leg first side 44. This rib 14 structure is included to better grip the implement being retain in the second clamp 7. Third leg 13 is resilient and forms a cantilevered element with the upper portion 40 being the non-fixed end of the beam and the second bottom portion 43 approximating the fixed end of the beam. When the upper portion 40 of the third leg 13 is deflected to receive the pencil therein it will have a natural tendency to return to it's undeflected position. As such, when the width of the pencil 17 exceeds the undeflected length F (the distance intermediate the third leg upper portion 40 and the second leg upper portion 26) there will be a natural gripping action mathematically related to the distance in excess of F. Also, most pencil diameter's will be such that they will be retained 'deeply' in the second clamp 7. That is to say, generally speaking, the height of the walls of the channel of the second clamp 7 will generally be greater by a multiple of at least 2 then the diameter of a conventional cylindrical pencil. This relationship may not hold for a carpenter's pencil. As such, the ribs 14 and the second clamp 7 will prevent the pencil 17 form sliding or falling from the holder 5. One of the advantages of the instant holder 5 over prior art devices is its capacity to hold irregularly shaped, non-cylindrical, elongated devices, such as a rectangular carpenter's pencil.

The third leg 13 is generally rectangular and flat as well. Its general height is less than the second leg 10 and the first leg 9. The third leg second side 46 is exposed and can be seen by other people. As such, it is designed to receive indicia 15 thereon. The indicia 15 may include, but is not limited to, advertising, trademarks, or identifying marks. The indicia 15 may also include ornamental structure, designs, patterns or other artistic representations.

Figure 4:
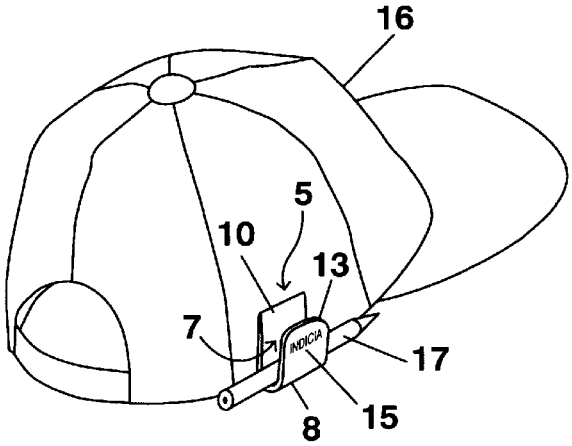
FIG. 4 is an environmental perspective view of the implement holder shown attached to a hat or cap.

Referring now specifically to FIG. 4, the implement holder 5 is shown affixed to a cap 16, holding pencil 17. As seen, when the pencil 17 or other implement is inserted intermediate second leg 10 and third leg 13, the second clamp 7 will self adjust to the thickness of the pencil 17. It is clearly seen that the pencil 17 will be readily accessible to the wearer of the cap 16.

It is apparent from the above that the present invention accomplishes all of the objectives set forth by providing a new and improved implement holder attached to a hat or cap which may be quickly and easily affixed and removed from the headwear and which may detachably mount a long slender instrument such as, but not limited to a writing instrument.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by letters patent of the United States is as follows:

1. An implement holder to be attached to a cap, hat, or other headwear, and retain a pencil, pen or the like therein said holder comprising:

a structure having a substantially planar first leg, a substantially planar second leg and a substantially planar third leg, said first leg, second leg and third leg depending upwardly from a bottom portion, said first leg and said second leg forming a first clamp, said second leg and said third leg forming a second clamp, said first clamp having a first width and said second clamp having a second width, wherein said first width is at most one half the length of said second width, and said first clamp is adapted to embrace the cap for detachably attaching said holder thereto, and said second clamp residing outside the cap and further being adapted to detachably receive a long slender instrument such as a pencil or pen therein.

2. An implement holder for a cap, hat and other headwear as claimed in claim 1, wherein said first leg and said second leg are generally flat rectangular elements.

3. An implement holder for a cap, hat and other headwear as claimed in claim 2, wherein said first leg is parallel to said second leg.

4. An implement holder for a cap, hat and other headwear as claimed in claim 3, wherein said second leg includes a first side and a second side, said second leg first side facing said first leg first side.

5. An implement holder for a cap, hat and other headwear as claimed in claim 4, wherein said third leg is generally flat and substantially rectangular including a top curved portion, said third leg further being resilient and able to adjust to receive a variety of elongated implements within said second clamp.

6. An implement holder for a cap, hat and other headwear as claimed in claim 5, wherein said third leg is generally parallel to said second leg, said third leg further including a first side and a second side, said third leg first side facing said second leg second side.

7. An implement holder for a cap, hat and other headwear as claimed in claim 6, wherein said second leg second side includes a plurality of lateral ridges running from a second side right side of said second leg to a second side left side of said second leg.

8. An implement holder for a cap, hat and other headwear as claimed in claim 7, wherein said third leg first side includes a plurality of lateral ridges running from a first side right side of said third leg to a first side left side of said third leg.

9. An implement holder for a cap, hat and other headwear as claimed in claim 8, wherein said third leg second side includes indicia selected from the group consisting of advertising, trademarks, identifying marks, ornamental structure, designs, patterns and artistic representations.

10. An implement holder for a cap, hat and other headwear as claimed in claim 1 wherein said structure is a one-piece molded structure.

11. An implement holder for a cap, hat and other headwear as claimed in claim 10 wherein said holder is manufactured from plastic.

* * * * *